US011511902B2

(12) United States Patent
Stoetzner

(10) Patent No.: US 11,511,902 B2
(45) Date of Patent: Nov. 29, 2022

(54) DEEP-DRAWING PACKAGING MACHINE WITH VACUUM COOLING STATION AND METHOD FOR VACUUM COOLING HOT-PACKAGED PRODUCTS

(71) Applicant: MULTIVAC SEPP HAGGENMUELLER SE & CO. KG, Wolfertschwenden (DE)

(72) Inventor: Alexander Stoetzner, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 24 days.

(21) Appl. No.: 17/162,164

(22) Filed: Jan. 29, 2021

(65) Prior Publication Data

US 2021/0237920 A1 Aug. 5, 2021

(30) Foreign Application Priority Data

Feb. 3, 2020 (DE) ..... 102020201284.9

(51) Int. Cl.
*B65B 63/08* (2006.01)
*B65B 7/16* (2006.01)
(Continued)

(52) U.S. Cl.
CPC ..... *B65B 63/08* (2013.01); *B65B 7/164* (2013.01); *B65B 9/04* (2013.01); *B65B 25/001* (2013.01);
(Continued)

(58) Field of Classification Search
CPC ..... B65B 63/08
(Continued)

(56) References Cited

U.S. PATENT DOCUMENTS 4,366,663 A * 1/1983 Grebe ..... B65B 31/021 425/123
5,088,293 A * 2/1992 Itou ..... A23L 3/0155 34/92
(Continued)

FOREIGN PATENT DOCUMENTS

CA 2957068 A1 * 8/2017 ..... A23B 7/0425
CN 202624688 U 12/2012
(Continued)

OTHER PUBLICATIONS

German Search Report dated Oct. 21, 2020, Application No. 10 2020 201 284.9, Applicant MULTIVAC Sepp Haggenmueller SE & Co. KG, 7 Pages.
(Continued)

*Primary Examiner* — Stephen F. Gerrity
(74) *Attorney, Agent, or Firm* — Brooks Kushman P.C.

(57) ABSTRACT

The disclosure relates to a deep-drawing packaging machine with a forming station for deep-drawing trays into a film, a loading stretch for filling products into the trays, and a sealing station for sealing the trays. The deep-drawing packaging machine further comprises at least one vacuum cooling station which is disposed in a direction of transport upstream of the sealing station and which is formed for vacuum cooling the products placed into the trays along the loading stretch. The disclosure furthermore relates to a method for vacuum cooling products.

19 Claims, 3 Drawing Sheets

(51) Int. Cl.

| | |
|---|---|
| ***B65B 9/04*** | (2006.01) |
| ***B65B 25/00*** | (2006.01) |
| ***B65B 31/02*** | (2006.01) |
| ***B65B 59/04*** | (2006.01) |

(52) U.S. Cl.
CPC ..... *B65B 31/021* (2013.01); *B65B 59/04* (2013.01); *B65B 2220/24* (2013.01)

(58) Field of Classification Search
USPC ..... 53/433, 511, 440, 127, 453, 559
See application file for complete search history.

(56) References Cited

U.S. PATENT DOCUMENTS

| | | | | |
|---|---|---|---|---|
| 5,290,580 | A * | 3/1994 | Floyd et al. | A23L 3/364 62/304 |
| 2004/0105927 | A1 | 6/2004 | Karman et al. | |
| 2006/0029704 | A1 | 2/2006 | Karman et al. | |
| 2008/0156804 | A1* | 7/2008 | Bardou et al. | B65B 31/00 99/359 |

FOREIGN PATENT DOCUMENTS

| | | | | | |
|---|---|---|---|---|---|
| DE | 29607689 | U1 | | 7/1996 | |
| EP | 2 690 023 | A1 | | 1/2014 | |
| EP | 3 491 926 | A1 | | 6/2019 | |
| JP | S57-1021 | A | | 1/1982 | |
| JP | H09-58613 | A | | 3/1997 | |
| JP | H09-207908 | A | | 8/1997 | |
| JP | 2002017318 | A | * | 1/2002 | A23L 3/00 |
| JP | 2018-118741 | A | | 8/2018 | |
| WO | WO-9606540 | A1 | * | 3/1996 | A23L 3/00 |
| WO | 2019/059206 | A1 | | 3/2019 | |

OTHER PUBLICATIONS

German Office Action (with English Machine Translation) dated Apr. 30, 2021, Application No. 10 2018 132 897.4, Applicant Multivac Sepp Haggenmueller SE & Co. KG, 8 Pages.

European Communication with Search Report (with English Machine Translation) dated May 31, 2021, Application No. 20214878.9-1016, Applicant Multivac Sepp Haggenmueller SE & Co. KG, 15 Pages.

* cited by examiner

DEEP-DRAWING PACKAGING MACHINE WITH VACUUM COOLING STATION AND METHOD FOR VACUUM COOLING HOT-PACKAGED PRODUCTS

CROSS-REFERENCE TO RELATED APPLICATIONS

This application claims foreign priority benefits under 35 U.S.C. § 119(a)-(d) to German patent application number DE 10 2020 201 284.9, filed Feb. 3, 2020, which is incorporated by reference in its entirety.

TECHNICAL FIELD

The disclosure relates to a deep-drawing packaging machine, and to a method for cooling products.

BACKGROUND

Such deep-drawing packaging machines are used to manufacture packagings in the shape of trays, where the products packaged therein are filled into the manufactured trays along a loading stretch of the deep-drawing packaging machine and the filled trays are then transported to a sealing station for sealing the trays.

If the products placed in the trays are hot products, for example pre-cooked filled pasta squares, they can be slightly cooled way of by an evacuation process carried out within the sealing station. However, it may be that the associated cooling effect is not sufficient to cool down the products to a desired temperature level prior to the sealing process, since the evacuation phase employed within the sealing station does not last long enough. Enclosing products that are too hot, however, can lead to undesirable precipitation settling inside the sealed packagings.

DE 296 07 689 U1 discloses a deep-drawing packaging machine with a sealing station having downstream in the direction of transport a mechanical cooling device which by use of cooling cushions mounted thereon presses on sealed packagings from above and below in order to cool them down after the sealing process downstream of the sealing station.

The disclosure is based on an object of providing a deep-drawing packaging machine and a method with which, in particular, products to be hot-packaged can be packaged with a uniform packaging quality and at an increased machine output rate.

SUMMARY

This object is satisfied by a deep-drawing packaging machine according to the disclosure, as well as a method according to the disclosure.

The deep-drawing packaging machine according to the disclosure comprises a forming station for deep-drawing trays into a film, a loading stretch for filling the trays with products, and a sealing station for sealing the trays. According to the disclosure, the deep-drawing packaging machine comprises at least one vacuum cooling station which is disposed in the direction of transport upstream of the sealing station and which is configured to vacuum-cool the products placed into the trays along the loading stretch. Products introduced hot can be pre-cooled to a desired (pre)temperature level already at the deep-drawing packaging machine, at a point in the direction of transport upstream of the sealing station, before they are transported to the sealing station for the sealing process. This ensures in particular that the products being hot-filled along the loading stretch are cooled prior to entering the sealing station in such a way that the evacuation process carried out within the sealing station needs to provide only a reduced cooling capacity in order to bring the products to a desired temperature level prior to the sealing process. With the disclosure, the actively controlled product cooling therefore already commences upstream of the sealing station within the separate vacuum cooling station according to the disclosure. In this way, the products can be brought to a predetermined temperature level in a particularly efficient manner, precisely and in a timed manner with regard to the sealing process.

The vacuum cooling station and the sealing station are preferably present in the form of spatially separated work stations on the deep-drawing packaging machine and are each configured to form at least one hermetically sealable evacuation chamber. In this way, cooling down the hot-filled products can be distributed selectively to different work stations, so that the products can be cooled down to a desired temperature level more efficiently due to the successive cooling effects obtained.

A variant provides that the vacuum cooling station comprises several hermetically sealable evacuation chambers which are arranged consecutively in the direction of transport. In this way, several evacuation chambers are used on the deep-drawing packaging machine upstream of the sealing station, by use of which the products passed therethrough can be cooled gradually so that the cooling process can be split over several machine work cycles. This leads to significantly increased machine output with consistent packaging quality. This allows the products to be cooled particularly gently, i.e., a little bit in every cooling chamber.

It is advantageous if the vacuum cooling station provides a separate vacuum pump. This means that the vacuum cooling station can carry out the evacuation process independently of other work stations of the deep-drawing packaging machine, quasi as a work station functioning in an autarkic manner. In particular, the operation of the vacuum pump of the vacuum cooling station is independent of the operation of a vacuum pump used at the sealing station so that the cooling process at the vacuum cooling station can be better controlled in a product-specific manner.

As an alternative to this, it would be conceivable to have the evacuation processes taking place at the sealing station and the vacuum cooling station be carried out simultaneously by way of a common vacuum pump. The sealing station and the vacuum cooling station have quasi the same vacuum pump.

A preferred variant provides that the vacuum cooling station comprises at least one filter unit for a ventilation process. The vacuum cooling station can then be ventilated using filtered air, which prevents the product from being contaminated with germs.

The sealing station and the vacuum cooling station, in particular their chamber walls, can be heated to a predetermined temperature level. In this way, precipitation of moisture on the sealing station and the vacuum cooling station can be prevented, or at least reduced.

The deep-drawing packaging machine preferably comprises at least one condenser for the selective removal of moisture. For example, moisture can be separated from the evacuated air of the sealing station and/or the vacuum cooling station in a selective manner using the condenser, which leads in particular to hygienic operation of the deep-drawing packaging machine. It is conceivable that the sealing station and/or the vacuum cooling station pass evacuation air from the respective evacuation chambers via heated lines to the condenser, where the moisture can be separated from the heated evacuation air.

The vacuum cooling station can be attached to a machine frame of the deep-drawing packaging machine upstream of the sealing station, optionally at different locations. This means that the vacuum cooling station can be used better in a flexible manner to pre-cool products filled at different temperatures. A variant provides a linear guide on the machine frame on which the vacuum cooling station is mounted such that it is displaceable in the direction of transport.

A particularly advantageous variant provides that the vacuum cooling station be configured in the form of a rollable carriage unit which can be temporarily positioned in a stationary manner on the deep-drawing packaging machine, in particular on its machine frame. This enables the mobile employment of the vacuum cooling station on the deep-drawing packaging machine. The vacuum cooling station in the form of a rollable carriage unit is particularly suitable for service and cleaning purposes.

For pretreating the products filled, the vacuum cooling station can comprise a protective gas device which is formed for subsequent gas flushing of the products that are vacuum cooled therein. This means that the products filled can be provided with a kind of gas envelope for onward transportation.

Opening and closing the vacuum cooling station can be synchronized with opening and closing the sealing station that is positioned in the direction of transport downstream thereof. It would be conceivable to have the opening and closing of the vacuum cooling station be triggered by the opening and closing of the sealing station.

The deep-drawing packaging machine preferably comprises a control unit for controlling and monitoring the processes running at the vacuum cooling station, regardless of in which form the vacuum cooling station and/or at which location the vacuum cooling station is present upstream of the sealing station on the thermoformed packaging machine. This can in particular be the same control unit that is also provided for controlling other work stations of the deep-drawing packaging machine, for example, the sealing station and/or the forming station positioned at the inlet on the machine frame for producing the trays.

With regard to a product temperature recorded along the loading stretch, one variant provides that an evacuation pressure that can be varied at the vacuum cooling station can be activated and/or an evacuation pressure curve running therein, for example, in the form of a controlled pressure curve, can be controlled. In this way, the cooling process within the vacuum cooling station can be carried out in a product-specific manner regarding the product temperatures measured, so that products with a uniform product temperature can be sealed within the sealing station. In other words, the products can therefore be fed to the sealing station at a desired product temperature, so that packagings with uniform product quality can be sealed therein.

It is conceivable that the vacuum cooling station comprises a temperature measuring unit, for example, in the form of a temperature sensor or a thermal imaging camera, with which the product temperature of a product available immediately upstream of the vacuum cooling station can be recorded, based on which the evacuation process can be controlled. Alternatively, the temperature measuring unit can be present as a separate unit upstream of the vacuum cooling station.

The disclosure also relates to a method for cooling products which are placed on trays along a loading stretch of a deep-drawing packaging machine. According to the disclosure, the products placed into trays are cooled outside a sealing station, within a vacuum cooling station of the deep-drawing packaging machine that is in the direction of transport upstream of the sealing station, by way of an evacuation process controlled thereon. In this way, the products placed into the trays reach a reduced temperature level already outside the sealing station, based on which temperature level better packagings of consistent quality can be produced by the subsequent processes carried out within the sealing station. Cooling the products upstream of the sealing station, which is actively controlled within the vacuum cooling station, already leads to an at least partial cooling effect which is favorable for the processes subsequently running within the sealing station. In particular, the products can be brought precisely to a desired temperature level until the sealing process is carried out.

BRIEF DESCRIPTION OF THE DRAWINGS

Advantageous embodiments of the disclosure shall be further explained hereafter based on the drawings, where.

Same components are designated with the same reference numerals throughout the figures.

DETAILED DESCRIPTION

Figure 1:
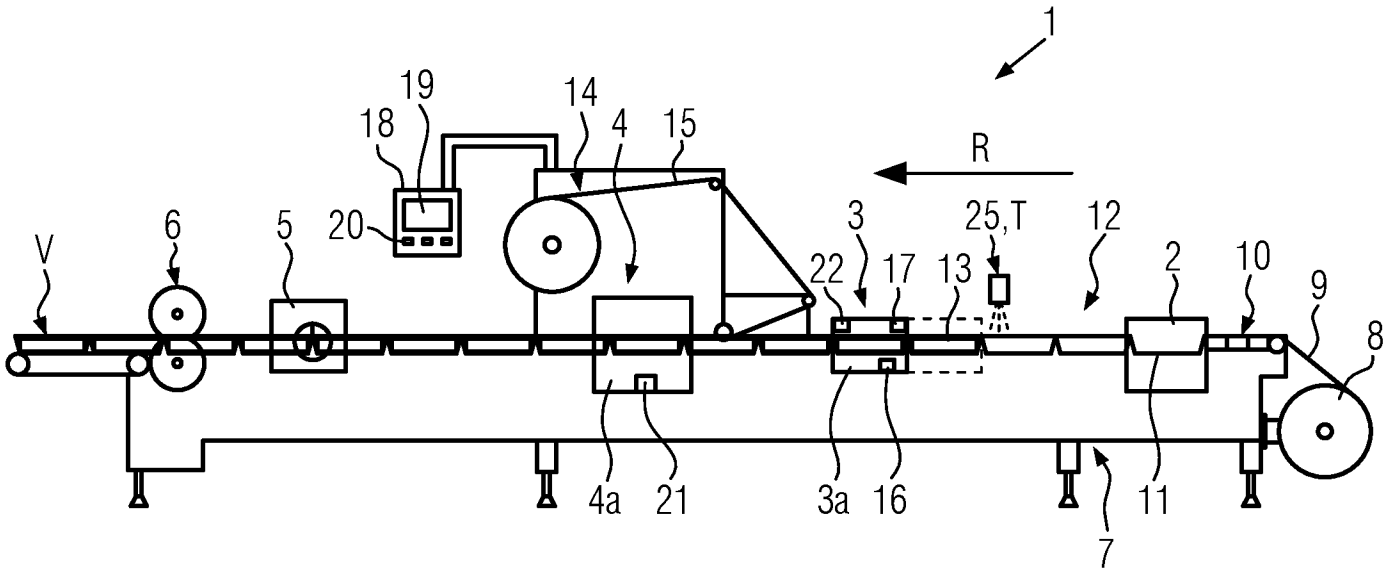
FIG. 1 shows a deep-drawing packaging machine with a vacuum cooling station.

FIG. 1 shows an intermittently operating deep-drawing packaging machine 1 according to the disclosure. Deep-drawing packaging machine 1 comprises a forming station 2, a vacuum cooling station 3, a sealing station 4, a transverse cutting device 5 and a longitudinal cutting device 6 which are arranged in this order in a direction of transport R on a machine frame 7.

Disposed on the inlet side on machine frame 6 is a supply roll 8 from which a base film 9 is drawn off. Furthermore, deep-drawing packaging machine 1 comprises a transport chain 10 which grips base film 9 and transports it onward in direction of transport R with every main work cycle.

In the embodiment shown according to FIG. 1, forming station 2 is configured as a deep-drawing station in which trays 11 are formed into base film 9 by deep-drawing, for example, by use of compressed air and/or vacuum. Forming station 2 can be configured such that several trays 11 are formed adjacent to one another in the direction perpendicular to direction of transport R. Provided in direction of transport R downstream of forming station 2 is a loading stretch 12 in which trays 11 having been formed into base film 9 are filled with products 13.

Vacuum cooling station 3 comprises a hermetically sealable chamber 3*a* in which the atmosphere in trays 11 can be evacuated. Vacuum cooling station 3 comprises a vacuum pump 16 for evacuating chamber 3*a*.

FIG. 1 further shows that vacuum cooling station 3 comprises a protective gas device 17 which is configured to gas flush vacuum cooled products 13. Products 13 transported into vacuum cooling station 3 can then be both vacuum cooled and gas flushed with an exchange gas or a gas mixture.

Sealing station 4 comprises a hermetically sealable chamber 4*a* in which the atmosphere in trays 11 is, e.g., evacuated and/or replaced by gas flushing with a replacement gas or with a gas mixture immediately prior to sealing with a top film 15 dispensed from a top film holder 14.

Transverse cutting device 5 can be configured as a punch that severs base film 9 and top film 15 between adjacent trays 11 in a direction transverse to direction of transport R. Transverse cutting device 5 there operates in such a manner that base film 8 is not severed across the entire width so that the film is not severed at least at one edge region. This enables controlled onward transportation by transport chain 10.

Longitudinal cutting device 6 can be configured as a blade assembly with which base film 8 and top film 10 are severed between adjacent trays 11 in direction of transport R and at the side edge of base film 8 so that separated packagings V are present downstream of longitudinal cutting device 6.

Deep-drawing packaging machine 1 also comprises a control unit 18. It serves the purpose of controlling and monitoring the processes running on the work stations in deep-drawing packaging machine 1. A display device 19 with elements 20 is used for visualizing or influencing the processes running in deep-drawing packaging machine 1 to or by an operator, respectively.

According to FIG. 1, vacuum cooling station 3 and sealing station 4 are configured in the form of spatially separated work stations on deep-drawing packaging machine 1. Unlike vacuum cooling station 3, sealing station 4 comprises its own vacuum pump 21 for carrying out an evacuation process within evacuation chamber 4*a*. Vacuum pump 16 of vacuum cooling station 3 and vacuum pump 21 of sealing station 4 are therefore present as separate vacuum pumps 16, 21 which can be controlled separately from one another by control unit 18.

Furthermore, FIG. 1 shows in dashed lines that vacuum cooling station 3 positioned upstream of sealing station 4 can comprise two or even more evacuation chambers 3*a* for carrying out successive vacuum cooling processes. Products 13 can be cooled down particularly gently therewith.

Furthermore, FIG. 1 shows schematically that vacuum cooling station 3 comprises a filter unit 22 through which sterile air that is filtered after the vacuum cooling by way of a ventilation process flows into chamber 3*a*.

FIG. 1 also shows a temperature measuring unit 25 by way of which a product temperature T of products 13 that are transported past underneath can be measured. With the aid of control unit 18 of the deep-drawing packaging machine 1, an evacuation pressure and/or an evacuation pressure curve with regard to recorded product temperature T can be set in an automated manner for the respective evacuation processes within the downstream vacuum cooling station 3.

Figure 2:
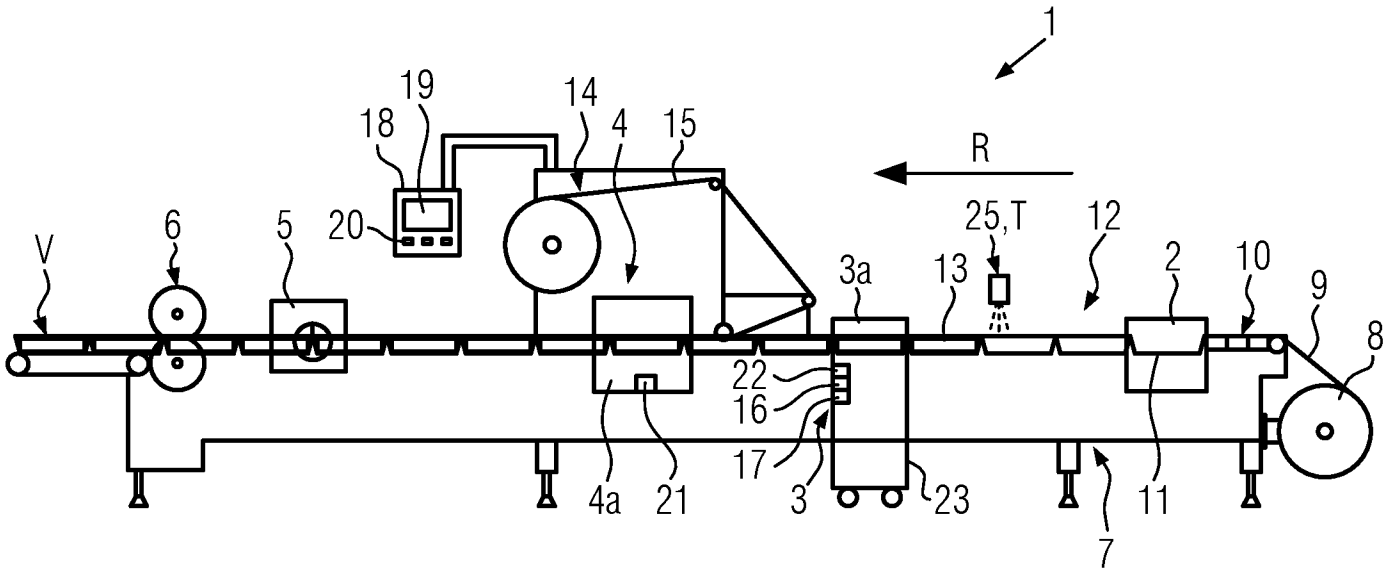
FIG. 2 shows a deep-drawing packaging machine with a vacuum cooling station in the form of a carriage unit.

FIG. 2 shows deep-drawing packaging machine 1 from FIG. 1, where vacuum cooling station 3 is configured in the form of a rollable carriage unit 23 which is located on deep-drawing packaging machine 1 upstream of sealing station 4 for cooling products 13 transported therethrough by way of an evacuation process before they reach downstream sealing station 4. Carriage unit 23 forms a mobile module which is particularly well suited for flexible employment on various types of deep-drawing packaging machines, since its positioning between loading stretch 12 and sealing station 4 can be freely selected.

Figure 3:
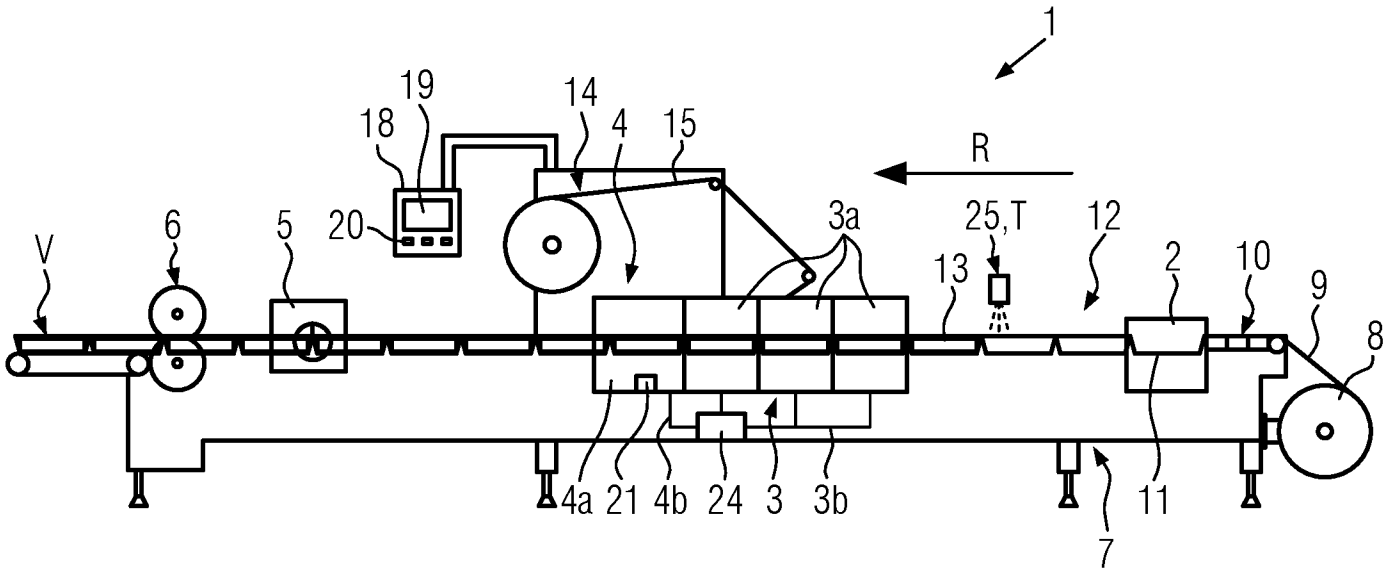
FIG. 3 shows a deep-drawing packaging machine with a multi-chamber vacuum cooling station.

FIG. 3 shows deep-drawing packaging machine 1 with a vacuum cooling station 3 configured as a multi-chamber vacuum cooling station which is positioned in direction of transport R immediately upstream of sealing station 4. The respective evacuation processes carried out successively within chambers 3*a* of vacuum cooling station 3 lead to the gradual controlled vacuum cooling of products 13 before they are transported into sealing station 4 for closing trays 11 with top film 15.

According to FIG. 3, vacuum cooling station 3 and sealing station 4 are configured as directly adjacent work stations, where an integrally formed structure is even conceivable for the two. FIG. 3 also shows that deep-drawing packaging machine 1 comprises a condenser 24 which is configured for the selective removal of moisture. Condenser 24 can also be employed in connection with vacuum cooling station 3 from FIG. 1 and FIG. 2.

An evacuation line 4*b* leads from sealing station 4 to condenser 24. Respective evacuation lines 3*b* also lead from chambers 3*a* of vacuum cooling station 3 to condenser 24. Evacuation lines 3*b*, 4*b* are preferably configured to be heatable so that moisture is separated from the air that is evacuated from chambers 3*a*, 4*a* in a selective manner only at condenser 24.

The present disclosure makes it possible by way of vacuum cooling to cool down products 13 hot-inserted along loading stretch 12 of deep-drawing packaging machine 1, possibly in stages using a multi-chamber cooling system, to a desired temperature level before they reach sealing station 4, so that the sealing process can be carried out within sealing station 4 in a more economical manner and at a consistent packaging quality.

What is claimed is:

1. A deep-drawing packaging machine comprising:

a forming station for deep-drawing trays into a film;

a loading stretch for filling the trays with products;

a sealing station for sealing the trays;

a vacuum cooling station which is disposed in a direction of transport upstream of the sealing station and which is configured to vacuum cool the products placed into the trays along the loading stretch; and at least one condenser that is operable to separate moisture from evacuated air of the vacuum cooling station.

2. The deep-drawing packaging machine according to claim 1, wherein the vacuum cooling station and the sealing station are present in a form of spatially separated work stations on the deep-drawing packaging machine and are each configured to form at least one hermetically sealable evacuation chamber.

3. The deep-drawing packaging machine according to claim 1, wherein the vacuum cooling station comprises several hermetically sealable evacuation chambers which are arranged consecutively in the direction of transport.

4. The deep-drawing packaging machine according to claim 1, wherein the vacuum cooling station comprises a separate vacuum pump.

5. The deep-drawing packaging machine according to claim 1, wherein the vacuum cooling station comprises at least one filter unit for a ventilation process.

6. The deep-drawing packaging machine according to claim 1, wherein the sealing station and the vacuum cooling station can be heated to a predetermined temperature level.

7. The deep-drawing packaging machine according to claim 1, wherein the vacuum cooling station is attachable to a machine frame of the deep-drawing packaging machine upstream of the sealing station at different locations.

8. The deep-drawing packaging machine according to claim 1, wherein the vacuum cooling station is configured as a rollable carriage unit which is positionable in a stationary manner on the deep-drawing packaging machine.

9. The deep-drawing packaging machine according to claim 1, wherein the vacuum cooling station comprises a protective gas device which is configured to gas flush vacuum cooled products.

10. The deep-drawing packaging machine according to claim 1, wherein opening and closing the vacuum cooling station is synchronizable with opening and closing the sealing station that is positioned downstream in the direction of transport.

11. The deep-drawing packaging machine according to claim 1, wherein the deep-drawing packaging machine comprises a control unit for controlling and monitoring processes running at the vacuum cooling station.

12. The deep-drawing packaging machine according to claim 1, wherein an evacuation pressure and/or an evacuation pressure curve can be activated with regard to a product temperature recorded along the loading stretch.

13. A method for cooling products which are placed into trays along a loading stretch of a deep-drawing packaging machine, wherein the products placed into the trays are cooled down outside a sealing station within a vacuum cooling station of the deep-drawing packaging machine in a direction of transport upstream of the sealing station using a vacuum cooling process controlled thereon, wherein the deep-drawing packaging machine comprises at least one condenser that separates moisture from air evacuated by the vacuum cooling station.

14. The method according to claim 13, wherein the products placed into the trays each pass through several evacuation chambers arranged consecutively in the direction of transport at the vacuum cooling station with a machine cycle of the deep-drawing packaging machine in order to be cooled down gradually.

15. A method for cooling products which are placed into trays along a loading stretch of a deep-drawing packaging machine, the method comprising:

cooling, using a vacuum cooling process in a vacuum cooling station of the deep-drawing packaging machine, the products placed into the trays, wherein the vacuum cooling station is disposed upstream, in a direction of transport, of a sealing station of the deep-drawing packaging machine; and separating moisture from air evacuated by the vacuum cooling station using at least one condenser.

16. The method according to claim 15, wherein the vacuum cooling station comprises multiple evacuation chambers arranged consecutively in the direction of transport, and the cooling comprises passing the products placed into the trays through the multiple evacuation chambers in order to cool the products gradually.

17. The method according to claim 15, wherein the vacuum cooling station is configured as a rollable carriage unit, and the method further comprises positioning the rollable carriage unit in a stationary manner on the deep-drawing packaging machine.

18. The method according to claim 15, further comprising gas flushing of the products that are cooled in the vacuum cooling station.

19. The method according to claim 15, further comprising measuring a product temperature upstream of the vacuum cooling station, and controlling an evacuation process of the vacuum cooling station based on the measured product temperature.

* * * * *